US005833051A

United States Patent [19]

Tiefenbrun et al.

[11] Patent Number: 5,833,051

[45] Date of Patent: Nov. 10, 1998

[54] MULTIFUNCTIONAL MUSICAL INSTRUMENT CASE

[76] Inventors: Jonathan Tiefenbrun, 62 Country Rd., Mamaroneck, N.Y. 10543; Peter J. Wilk, 185 West End Ave., Unit 22M, New York, N.Y. 10023

[21] Appl. No.: 821,526

[22] Filed: Mar. 21, 1997

[51] Int. Cl.[6] ..... A45C 11/00

[52] U.S. Cl. ..... 206/14; 206/314; 206/522

[58] Field of Search ..... 206/14, 314, 522; 383/3; 190/102; 248/433

[56] References Cited

U.S. PATENT DOCUMENTS

| | | | |
|---|---|---|---|
| 3,707,225 | 12/1972 | Miles et al. | 206/522 |
| 4,215,778 | 8/1980 | Kovins | 206/314 |
| 4,474,290 | 10/1984 | De Mato | 206/314 |
| 4,846,340 | 7/1989 | Walther | 206/14 |
| 5,217,131 | 6/1993 | Andrews | 206/522 |
| 5,219,075 | 6/1993 | White | 206/314 |

*Primary Examiner*—David T. Fidei

*Attorney, Agent, or Firm*—R. Neil Sudol; Henry D. Coleman

[57] ABSTRACT

A guitar case has a casing frame including a plurality of inflatable bladders for defining a compartment for receiving a guitar and for resiliently supporting the guitar placed in the compartment. The bladders when inflated or expanded substantially surround and grip the guitar in the compartment. The bladders are releasably connected to one another along their peripheries, by a zipper or by VELCRO™ type loop and hook fasteners. The two halves of the inflatable guitar case may be completely separable. In that case, at least one of the bladders is provided with a shelf for supporting the guitar and with a stand element for supporting the bladder and the guitar in an upright orientation. The guitar case may be a stand-alone case and in that event is provided with a handle or hand grip for facilitating manual transport of the case and the guitar therein. Alternatively, the above-described guitar case may function as a liner to be inserted in a conventional guitar case with rigid or semirigid panels. In that event, the bladder or bladders have an outer surface which substantially conforms to an inner surface of the conventional guitar case.

21 Claims, 5 Drawing Sheets

MULTIFUNCTIONAL MUSICAL INSTRUMENT CASE

BACKGROUND OF THE INVENTION

This invention relates to a case for a musical instrument. More particularly, this invention relates to a musical instrument case which has multiple functions, including, for example, as a case, a hanger, a case liner, and a stand.

Professional guitar players, as well as devoted and conscientious amateurs, are extremely protective of their instruments. The instruments not only produce beautiful sound but are also visually pleasing. Damage to guitars can be deleterious to both the looks and the acoustic qualities of the guitars. Acoustic guitars are especially delicate.

Guitars players, both amateur and professional, must take great care of their instruments. The instruments are closely watched not only during transit but also during use. During intermissions in guitar playing, an instrument is occasionally deposited on a floor surface, for example, against a wall, or on an article of furniture. However, the resting instrument is frequently unstable, particularly when leaning against a wall. In addition, if people other than the guitar user are present, those people are apt to bump against the guitar, inadvertently causing possible damage. Accordingly, the guitar owner must be constantly vigilant whenever the guitar is out of its protective case. The necessity for such vigilance not only reduces the pleasure that the guitar owner might have in a social situation, but can be tiring as well.

Even in its carrying case, a guitar is subjected to bumps or knocks which can cause significant damage.

OBJECTS OF THE INVENTION

An object of the present invention is to provide a device for enhancing the protection afforded to a guitar or other musical instrument.

A more particular objection of the present invention is to provide such a device which increases protection for a musical instrument whether the instrument is being transported, stored or laid aside during a concert intermission or other extended use.

Another, related object of the present invention is to provide a device which is capable of multiple functions relating to the care of musical instruments.

More specifically, it is an object of the present invention to provide a device which can function as a liner, a case, a hanger and a stand for a guitar or other musical instrument.

A further object of the present invention is to provide a device of the above mentioned type which is inexpensive, easy to operate and light in weight.

An associated object of the present invention is to provide a music stand for guitars and other instruments, especially a music stand which is inexpensive, collapsible, easy to operate and light in weight.

These and other objects of the present invention will be apparent from the drawings and descriptions herein.

SUMMARY OF THE INVENTION

A musical instrument case comprises, in accordance with the present invention, a casing frame including at least one inflatable bladder for defining therewith a compartment for receiving a musical instrument and for resiliently supporting the musical instrument placed in the compartment. A valve is connected to the bladder for enabling introduction of a fluid into the bladder to expand the bladder. The frame may be flexible support members which are integral with the bladder.

In one embodiment of the present invention, the bladder is one of a plurality of inflatable bladders included in the frame which when inflated or expanded substantially surround the musical instrument in the compartment. Thus, the musical instrument may include two bladders or balloons, one for the top of the musical instrument and for the bottom of the musical instrument. The bladders, when inflated, enclose and grip the musical instrument and define a compartment which conforms closely to the musical instrument. Accordingly, the bladders when expanded have a plurality of surfaces conforming to respective surfaces of the musical instrument. The inflated bladders or balloons form shock absorbers for protecting the musical instrument from bumps and knocks.

Preferably, the surfaces of the inflatable bladders which conform to respective musical instrument surfaces and accordingly define the compartment in which the musical instrument is received are made of, or lined with, a soft material such as velour. In addition, the outer surfaces of the musical instrument case and particularly those outer surfaces which are bladder walls are made of, or covered with, a cut resistant material. The outer surfaces of the musical instrument case are optionally provided with decorative designs.

The bladders may be releasably connected to one another along their peripheries, for example, by a zipper or by VELCRO™ type loop and hook fasteners. In a specific application of this principle, the bladders are only partially separable along their peripheries and remain permanently hinged together, as in conventional guitar cases. Alternatively, the two halves of an inflatable musical instrument case may be completely separable. In that case, one half may be designed to perform another function. Specifically, according to a feature of the invention, at least one of the bladders is provided with a stand element for supporting the one bladder in an upright orientation. That one bladder is additionally provided with a shelf for supporting the musical instrument in the upright orientation of the one bladder. The stand element preferably includes an inflatable bladder element coupled to the one bladder.

A musical instrument case as described about can serve as a stand-alone case and in that event is provided with a handle or hand grip for facilitating manual transport of the case and the musical instrument therein. Alternatively, the above-described musical instrument case may function as a liner to be inserted in a conventional musical instrument case with rigid or semirigid panels. In this case, the bladder or bladders have an outer surface which substantially conforms to an inner surface of the conventional musical instrument case.

According to a further feature of the present invention, the frame is provided with a hanger element, e.g., a strap or a hook, for suspending the musical instrument case together with a musical instrument disposed therein. Thus, the musical instrument may be stored in a clothing closet, on a clothing rack or support bar. When so suspended, the musical instrument may be protected by the inflated bladders of the case.

Generally, it is contemplated that the bladders have respective valves for enabling introduction of fluid (air) separately into the respective bladders.

A musical instrument stand comprises, in accordance with the present invention, a frame including at least one inflatable bladder for defining therewith a shelf for receiving a musical instrument and for resiliently supporting the musical instrument placed on the shelf. A valve is connected to the bladder for enabling introduction of a fluid into the bladder to expand the bladder.

The stand frame is preferably provided with a stand element for supporting the frame with the bladder in an upright orientation. The stand element may specifically include an inflatable bladder element coupled to the frame.

The bladder of the stand may be one of a plurality of inflatable bladders included in the stand frame which when inflated or expanded define an enclosed compartment for receiving the musical instrument. The shelf then forms a surface of the compartment, and the bladder substantially surround the musical instrument in the compartment. The bladders are movably connected to one another, e.g., via zippers, to enable an opening of the compartment.

The bladder or bladders of the musical instrument stand may fit as a liner into a substantially inflexible conventional musical instrument case, the stand frame with the bladder(s) having an outer surface which substantially conforms to an inner surface of the conventional musical instrument case.

A music stand comprises, in accordance with a related embodiment of the present invention, a frame including an expandable bladder which is inflatable from a collapsed state to an expanded state having a predetermined shape including a shelf and a support surface adjacent to the shelf, the surface being inclined relative to a gravity vector so that the shelf and the surface cooperate in supporting a sheet of paper. A valve is connected to the bladder for enabling introduction of a fluid into the bladder to expand the bladder from the collapsed state to the expanded state.

In accordance with an aspect of the invention, the music stand also includes a component for anchoring the music stand frame with the inflated bladder to a horizontal ground or floor surface. This anchoring component may be flaps connected to a base of the frame, whereby weights can be placed on the flaps to hold the frame with the inflated bladder means in an upright orientation. Alternatively, the anchoring component may be a band connected to a base of the music stand frame, whereby the frame with the inflated bladder may be attached to an object underlying the frame on the horizontal ground or floor surface. Reinforcement ribs are advantageously provided on the bladder for stiffening the bladder to assist the bladder to stand upright upon inflation thereof A musical instrument case in accordance with the present invention is multifunctional and substantially enhances the protection afforded to a musical instrument. The device increases protection for a musical instrument whether the musical instrument is being transported, stored or laid aside during an intermission in a concert performance or other extended use. The device can function as a liner, a case, a hanger and a stand for a guitar, a cello or other musical instrument. The multifunctional case is inexpensive, easy to operate and light in weight. An associated music stand for guitars and other instruments is inexpensive, collapsible, easy to operate and light in weight.

DESCRIPTION OF THE PREFERRED EMBODIMENT

Figure 1:
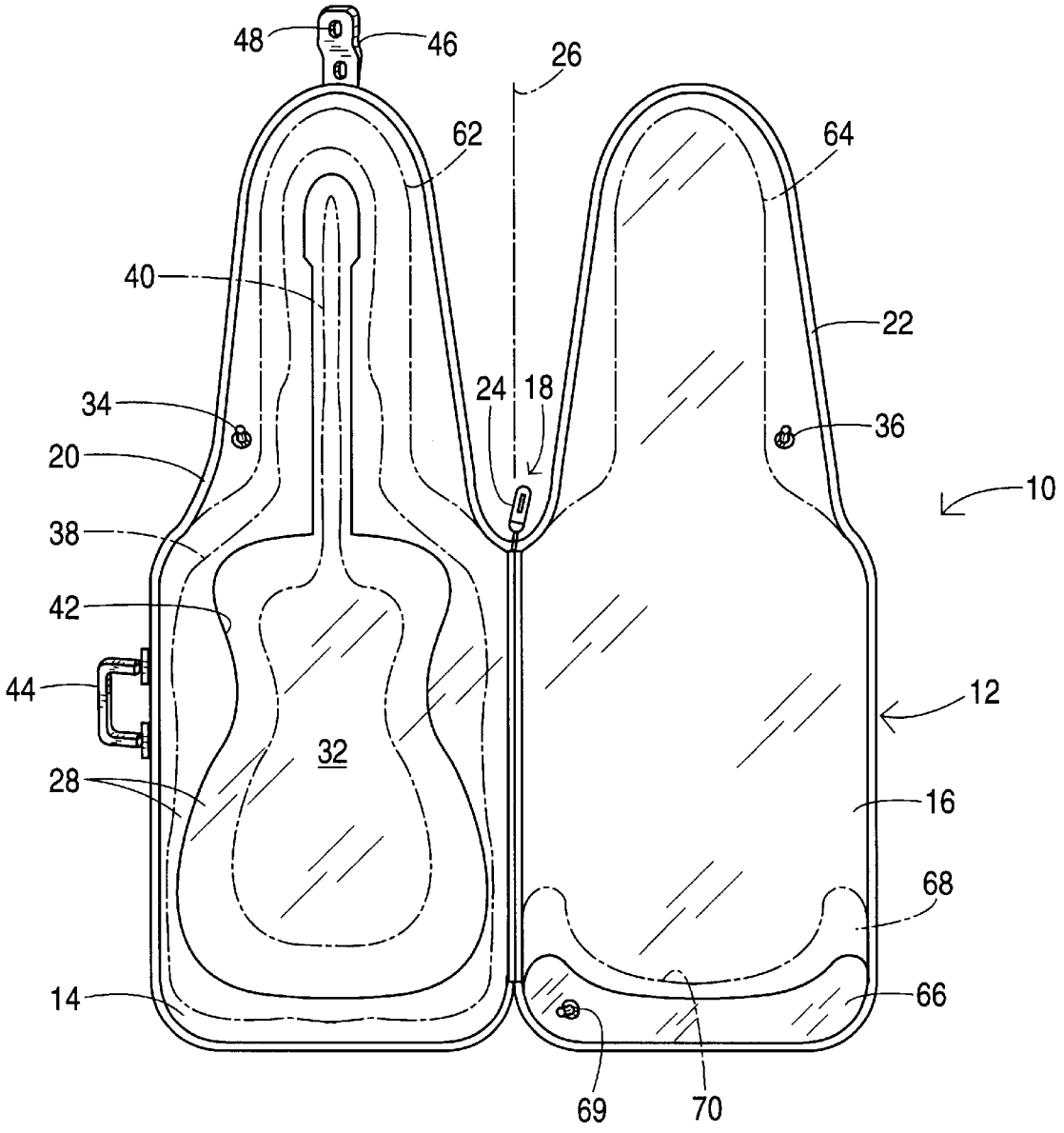
FIG. 1 is a schematic elevational view of a multifunctional guitar case in accordance with the present invention, showing the case in an opened configuration.
Figure 2:
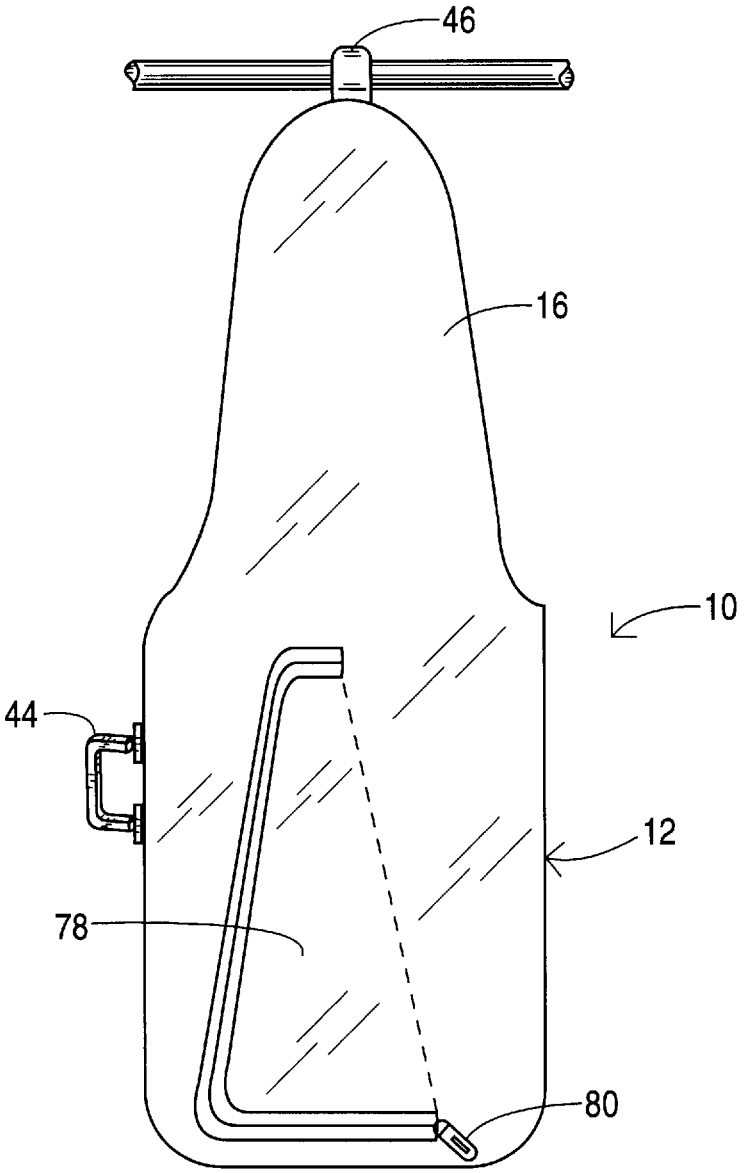
FIG. 2 is a rear elevational view of the multifunctional guitar case of FIG. 1, with the guitar case in a closed configuration.

As illustrated in FIGS. 1 and 2, a multifunctional guitar case 10 comprises a casing frame 12 incorporating two inflatable bladders or balloon members 14 and 16 connected to one another by a zipper 18. Zipper 18 has two toothed zipper elements 20 and 22 each extending around the periphery of a respective one of bladders or balloon members 14 and 16. Zipper 18 further includes a manually graspable pull tab 24. In FIG. 1, zipper 18 is in a partially unzipped configuration which enables an unfolding or pivoting of bladders 14 and 16 relative to one another about an axis 26. Bladders 14 and 16 generally form mirror halves of casing frame 12.

Generally, frame 12 largely consists of flexible interior walls 28 and flexible exterior walls 30 of bladders 14 and 16. Interior walls 28 are preferably provided with a soft lining material such as velour (not shown). Exterior walls 30 are made of a cut resistant material and may be provided with decorative designs, for example, in the form of decals (not shown).

Interior walls 28 define a compartment 32 for receiving a guitar and for resiliently supporting the guitar placed in the compartment. Bladders 14 and 16 are provided with respective valves 34 and 36 which enable a user to blow or otherwise inject air or other pressurizing fluid into the bladders to thereby expand the same from a collapsed configuration to an expanded cushioning configuration in which the guitar is surrounded and gripped by the bladders. As illustrated in FIG. 1, bladder 14 has an irregular collapsed or uninflated profile 38. If bladder 14 is inflated without the prior deposition of a guitar in the bladder, bladder 14 can be inflated to have a profile 40. However, with the placement of a guitar in case 10 and a subsequent pressurized expansion of bladder 14, the bladder assumes a profile 42 which conforms to the guitar and partially defines compartment 32.

As illustrated in FIG. 1, bladder 16 has an essentially slab-like configuration in the expanded state and forms a single surface (an upper surface) of compartment 32. Of course, other conformations of bladders 14 and 16 are possible. For example, bladder 16 might be also formed with to assume a guitar-shaped profile like profile 42. In addition, it is to be noted that each half of guitar case 10 might include a plurality of balloon members, each such plurality together performing the protective shock-absorbing functions of a respective bladder 14 or 16.

Guitar case 10 may be used to store and transport a guitar and to that end is provided with a grip or handle 44. In addition, case 10 is provided at one end with a strap 46 which has a pair of snap-lock fasteners or VELCRO™ type loop and hook fasteners 48 and 49 for cooperating to form strap 46 into a loop which can be manipulated to surround a bar 48 (FIG. 2), for example, a clothing rack bar, so that case 10, with or without a guitar therein, may be suspended for storage purposes.

Figure 3:
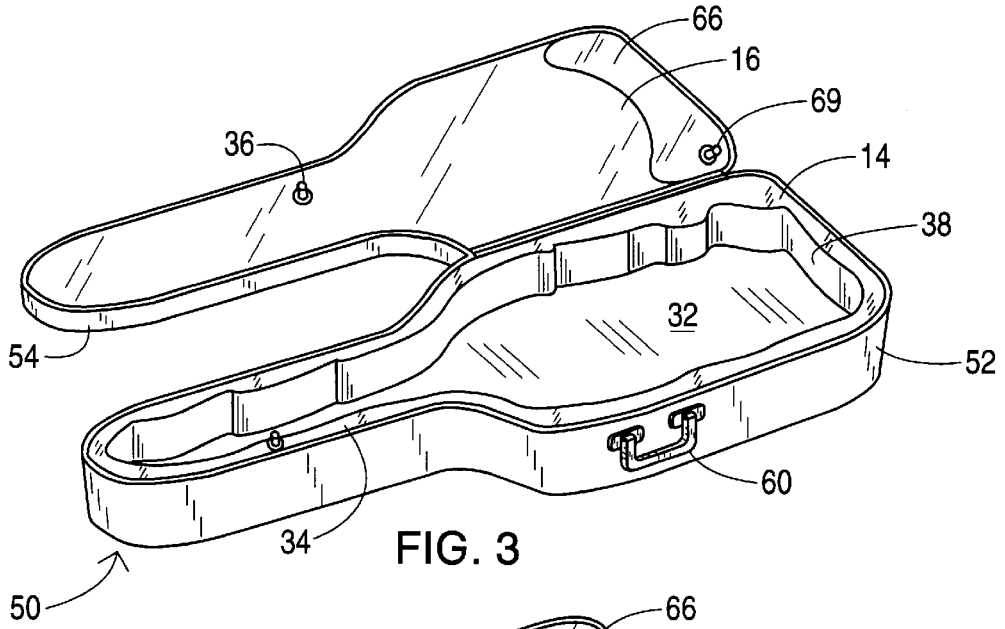
FIG. 3 is a schematic perspective view of a conventional guitar case with the guitar case of FIGS. 1 and 2 inserted as a liner in a partially collapsed configuration in the conventional case.
Figure 4:
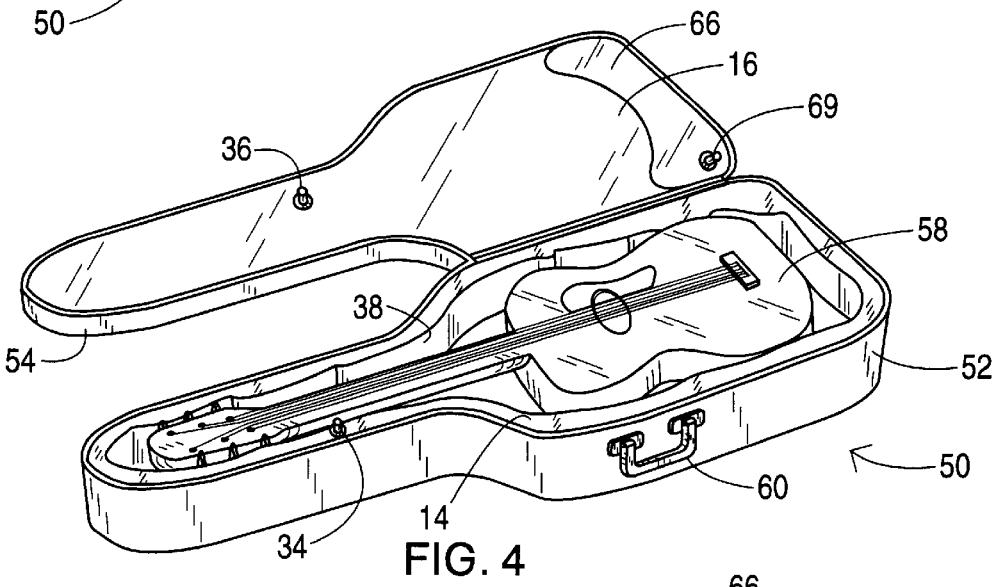
FIG. 4 is a schematic perspective view similar to FIG. 3, showing a guitar placed in the partially collapsed guitar case/liner of the present invention.
Figure 5:
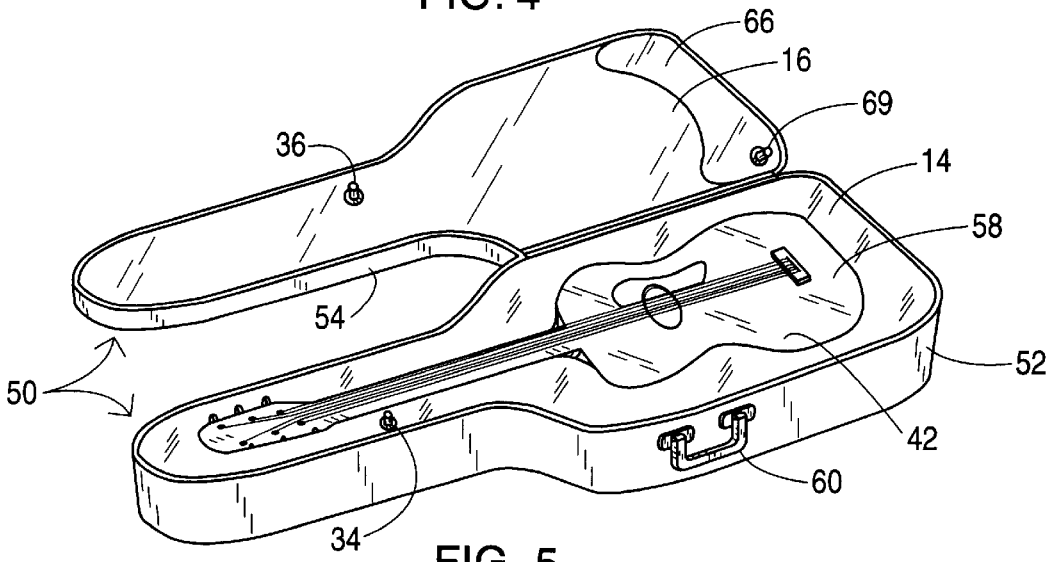
FIG. 5 is a schematic perspective view similar to FIGS. 3 and 4, showing the guitar case/liner of the invention inflated to hold the guitar.

Guitar case 10 may also or alternatively be used as a liner for a conventional semirigid guitar case 50, shown in FIGS. 3–5. As illustrated in FIG. 3, bladder 14 of case 10 is inserted in an uninflated state into a lower half 52 of conventional guitar case 50. Upper bladder 16 rests against an upper half 54 of conventional guitar case 50. VELCRO™ type loop and hook fasteners (not shown) may be provided for removably fixing bladders 14 and 16 to case halves 52 and 54, respectively. FIG. 3 shows bladder 14 with deflated inner profile 38.

As depicted in FIG. 4, a guitar 58 is placed in bladder 14. The fit of the bladder 14 to the guitar 58 is loose insofar as uninflated profile 38 does not necessarily conform to the various panels of guitar 58.

After the placement of guitar 58 in bladder 14, bladder 14 is pressurized and expanded via valve 34 so that the bladder acquires inner profile 42 conforming substantially to guitar 58, as illustrated in FIG. 5. Upper bladder 16 is pressurized or inflated via valve 36. Thereafter, guitar case 50 is closed in a conventional pivoting and fastening operation. Case 50 is provided with a grip or handle 60 for case transport purposes.

FIG. 1 shows in phantom lines 62 and 64 that the outer peripheries of bladders 14 and 16 assume the contours of guitar case 50 when the case of FIGS. 1 and 2 is used as a liner as discussed above with reference to FIGS. 3–5.

Figure 6:
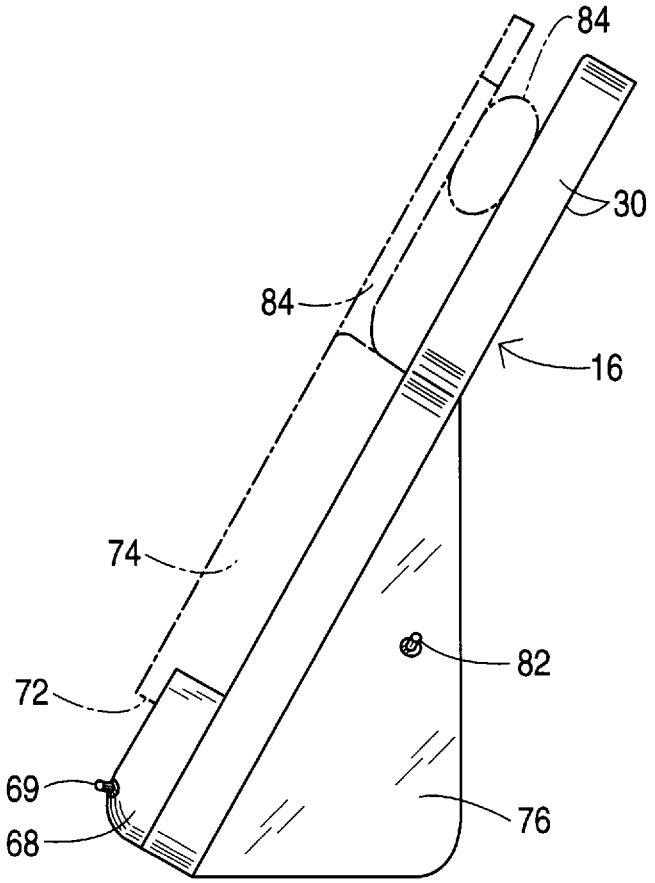
FIG. 6 is a side elevational view, showing use of the guitar case/liner of FIGS. 1 and 2 as a guitar stand in accordance with the present invention.

As depicted in FIGS. 1 and 6, bladder 16 is provided along an inner surface with an ancillary balloon 66 for providing a support shelf 68 when bladder 16 is separated from bladder 14 and used as a guitar stand, as shown in FIG. 6. Ancillary balloon 66 has an inflation (and deflation) valve 69 whereby the balloon can be expanded from a non-use configuration shown in solid lines in FIG. 1 to the configuration of shelf 68, shown in phantom lines in FIG. 1. Shelf 68 has an upper surface 70 which conforms to a lower surface 72 of a guitar 74 so as to support the guitar in a generally upright but angled orientation.

Bladder 16 is additionally provided with another ancillary balloon 76 which is expanded to form a stand element, as illustrated in FIG. 6. Balloon 76 is stored in a pocket partially defined by a flap 78 (FIG. 2) releasably fastened to bladder 16 via a zipper 80. When zipper 80 is unzipped, the user obtains access to an inflation/deflation valve 82 used to pressurize balloon 76 to expand that balloon to form a substantially block shaped stand capable of supporting bladder 16 and guitar 74 in the generally upright but angled orientation depicted in FIG. 6. Of course, bladder 16 is inflated when performing the guitar stand function depicted in FIG. 6.

Another ancillary balloon 84 (FIG. 6) is available for cradling a neck 86 of guitar 74.

In another embodiment of case 10, bladder 14 is used as the angled support. In that event, an ancillary balloon (not shown) for forming a guitar shelf defines a surface of compartment 32 when frame 12 is used as a guitar case, bag or liner.

Figure 7:
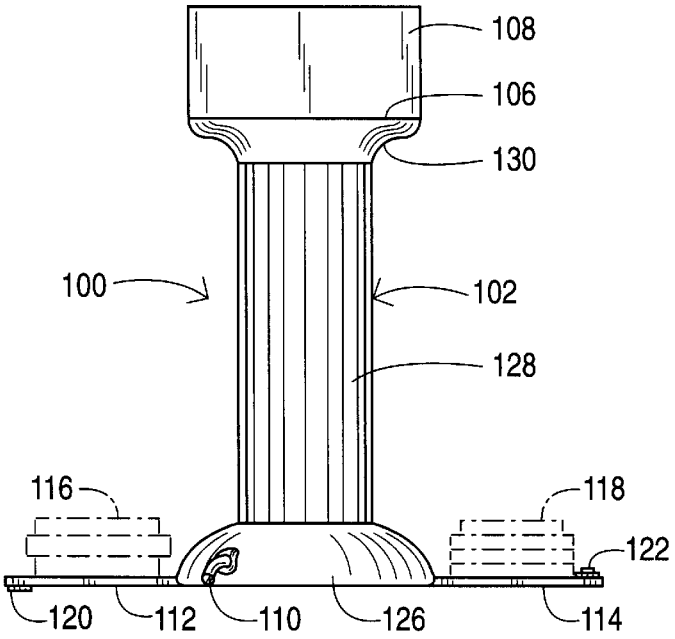
FIG. 7 is a schematic front elevational view of an alternately collapsible and expandable music stand in accordance with the present invention.
Figure 8:
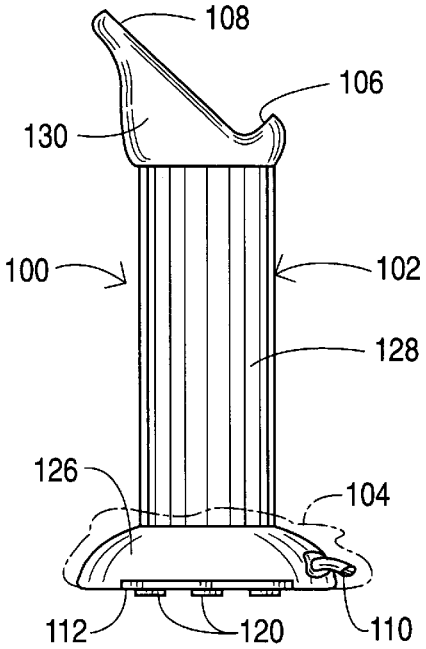
FIG. 8 is a schematic side elevational view of the music stand of FIG. 7.

As illustrated in FIGS. 7 and 8, a music stand comprises a frame 100 including an expandable bladder 102 which is inflatable from a collapsed storage and transport state 104 to an expanded use state having a predetermined shape including a shelf 106 and a support surface 108 adjacent to the shelf. Surface 108 is inclined relative to a vertical or a gravity vector so that shelf 106 and surface 108 cooperate in supporting one or more sheets of paper carrying musical arrangements. A valve 110 is connected to bladder 102 for enabling introduction of a fluid such as air into the bladder to expand the bladder from the collapsed state 104 to the expanded state.

Figure 9:
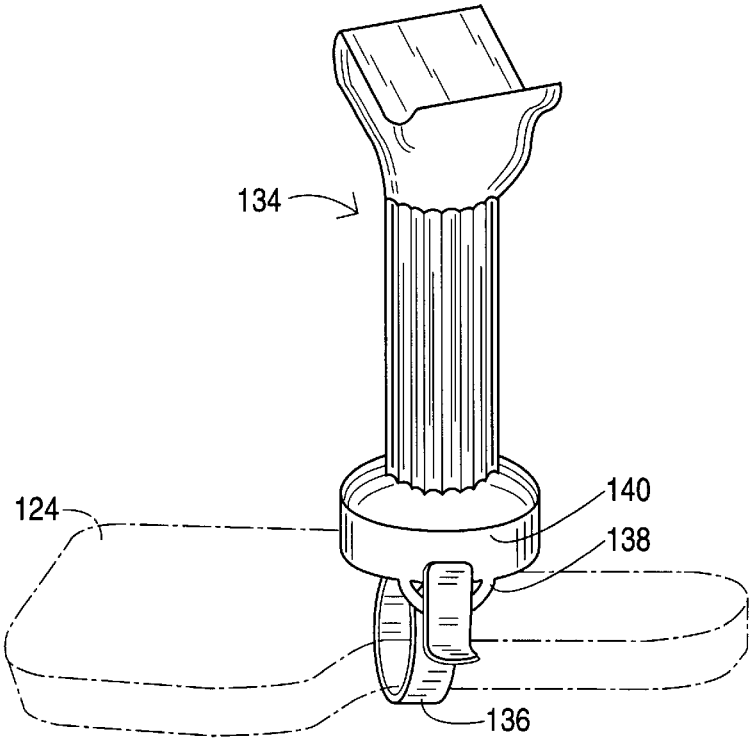
FIG. 9 is a schematic perspective view of a modified music stand in accordance with the present invention.

Frame 100 is provided with a pair of straps or flaps 112 and 114 for anchoring the frame with bladder 102 in the inflated use configuration to a horizontal ground or floor surface. Straps or flaps 112 and 114 may be spread along the floor surface for receiving weights such as books 116 and 118. Straps or flaps 112 and 114 may be provided with snap-lock fasteners 120 and 122 which can be connected to one another after straps or flaps 112 and 114 have been wrapped around an anchoring object, such as a conventional guitar case 124 (FIG. 9).

Bladder 102 has a base 126, a central column 128 and a crown 130 provided with shelf or ledge 106 and surface 108. Column 128 is formed with ribs or ridges 132 for stiffening bladder 102 in the area of the column to assist the bladder to stand upright upon inflation thereof As illustrated in FIG. 9, an inflatable music stand 134 is removably attachable to an anchoring object such as guitar case 124 via a single strap 136 provided with snap-lock fasteners or VELCRO™ type loop and hook fasteners (not shown). Strap 136 is drawn around guitar case 124 and inserted through a loop or bracket 138 on a base 140 of music stand 134.

Although the invention has been described in terms of particular embodiments and applications, one of ordinary skill in the art, in light of this teaching, can generate additional embodiments and modifications without departing from the spirit of or exceeding the scope of the claimed invention.

Accordingly, it is to be understood that the drawings and descriptions herein are proffered by way of example to facilitate comprehension of the invention and should not be construed to limit the scope thereof.

What is claimed is:

1. A case for a musical instrument, comprising:

a casing frame including a plurality of inflatable bladders for defining therewith a compartment for receiving a musical instrument and for resiliently supporting the musical instrument placed in said compartment; and a valve connected to at least one of said bladders for enabling introduction of a fluid into said bladders to expand the bladders, at least one of said bladders being provided with a stand element for supporting said one of said bladders in an upright orientation, said one of said bladders being additionally provided with a shelf for supporting said musical instrument in said upright orientation of said one of said bladders.

2. The musical instrument case defined in claim 1 wherein said bladders when inflated or expanded substantially surround the musical instrument in said compartment.

3. The musical instrument case defined in claim 2 wherein said bladders have respective peripheries, said bladders being releasably connected to one another along said peripheries.

4. The musical instrument case defined in claim 1 wherein said stand element includes an inflatable bladder element coupled to said one of said bladders.

5. The musical instrument case defined in claim 3 wherein said bladders are releasably connected to one another by a zipper.

6. The musical instrument case defined in claim 2 wherein said frame is provided with a handle for enabling a manual transport of the musical instrument case together with a musical instrument disposed therein.

7. The musical instrument case defined in claim 6 wherein said frame is further provided with a hanger element for suspending the musical instrument case together with a musical instrument disposed therein.

8. The musical instrument case defined in claim 7 wherein said hanger element includes a flexible strap.

9. The musical instrument case defined in claim 2 wherein each of said bladders has a respective valve for enabling introduction of fluid into the respective bladder to expand the same.

10. The musical instrument case defined in claim 2 wherein said bladders when expanded have a plurality of surfaces conforming to respective surfaces of the musical instrument.

11. The musical instrument case defined in claim 1 wherein at least one of said bladders when expanded has a predetermined surface conforming to a surface of the musical instrument.

12. The musical instrument case defined in claim 1 wherein said frame with said bladders fits as a liner into a substantially inflexible conventional musical instrument case, said frame with said bladders having an outer surface which substantially conforms to an inner surface of the conventional musical instrument case.

13. The musical instrument case defined in claim 1 wherein said stand element includes an inflatable bladder element.

14. The musical instrument case defined in claim 1 wherein said frame is provided with a handle for enabling a manual transport of the musical instrument case together with a musical instrument disposed therein.

15. A case for a musical instrument, comprising:

a casing frame including an inflatable bladder defining a compartment for receiving a musical instrument and for resiliently supporting the musical instrument placed in said compartment;

a valve connected to said bladder for enabling introduction of a fluid into said bladder to expand the bladder; and a stand element connected to said bladder for supporting said bladder in an upright orientation, said bladder being additionally provided with a shelf for supporting said musical instrument in said upright orientation of said bladder.

16. The musical instrument case defined in claim 15 wherein said frame is provided with a handle for enabling a manual transport of the musical instrument case together with a musical instrument disposed therein.

17. The musical instrument case defined in claim 16 wherein said frame is provided with a hanger element for suspending the musical instrument case together with a musical instrument disposed therein.

18. The musical instrument case defined in claim 17 wherein said hanger element includes a flexible strap.

19. The musical instrument case defined in claim 15 wherein said stand element includes an inflatable bladder element coupled to said bladder.

20. The musical instrument case defined in claim 15 wherein said bladder when expanded has a predetermined surface conforming to a surface of the musical instrument.

21. The musical instrument case defined in claim 15 wherein said frame with said bladder fits as a liner into a substantially inflexible conventional musical instrument case, said frame with said bladder having an outer surface which substantially conforms to an inner surface of the conventional musical instrument case.

* * * * *